United States Patent [19]

Gibson

[11] 4,178,817

[45] Dec. 18, 1979

[54] POWERED PIPE WRENCH

[76] Inventor: John Gibson, P.O. Box 2226, Gastonia, N.C. 28052

[21] Appl. No.: 903,722

[22] Filed: May 8, 1978

Related U.S. Application Data

[63] Continuation-in-part of Ser. No. 899,373, Apr. 24, 1978, abandoned.

[51] Int. Cl.[2] ..... B25B 17/00

[52] U.S. Cl. ..... 81/57.13; 81/57.15

[58] Field of Search ..... 81/57.11, 57.12, 57.13, 81/57.14, 57.17, 57.15, 57.16–57.21, 57.29

[56] References Cited

U.S. PATENT DOCUMENTS

| | | | |
|---|---|---|---|
| 2,400,712 | 5/1946 | Prather et al. | 81/57.15 |
| 2,576,203 | 11/1951 | Wilson | 81/57.15 |
| 3,752,016 | 8/1973 | Ballard | 81/57.17 |
| 3,774,481 | 11/1973 | Goodman | 81/57.13 |

*Primary Examiner*—James L. Jones, Jr.

*Attorney, Agent, or Firm*—Clifton T. Hunt, Jr.

[57] ABSTRACT

A powered wrench for connecting links of pipe, the wrench including means for operatively engaging a length of pipe with a power driven toothed roller to rotate the pipe in a desired direction. The wrench includes idler rolls for applying supporting and smoothing pressure to the pipe responsive to the actuation of pressure applying means carried by the wrench.

7 Claims, 11 Drawing Figures

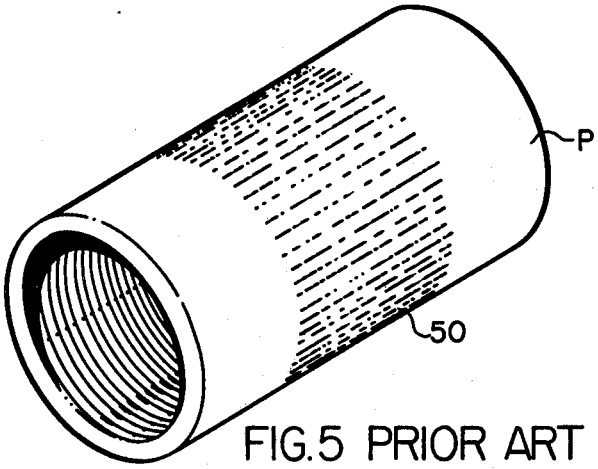
FIG. 5 PRIOR ART
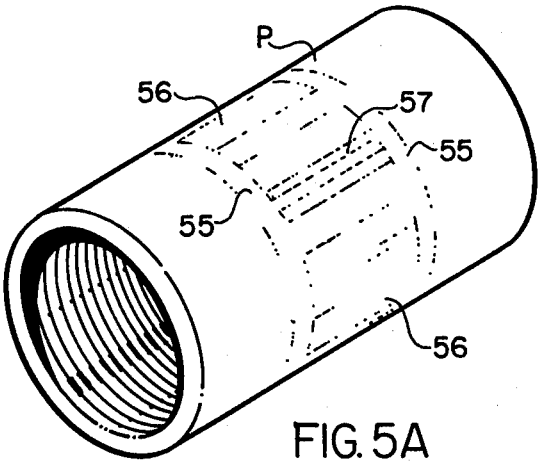
FIG. 5A
FIG. 6
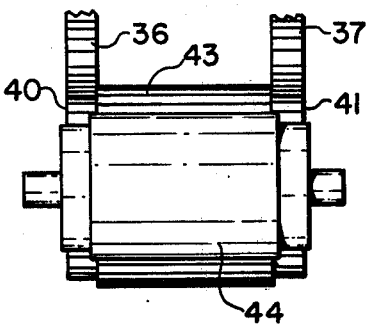
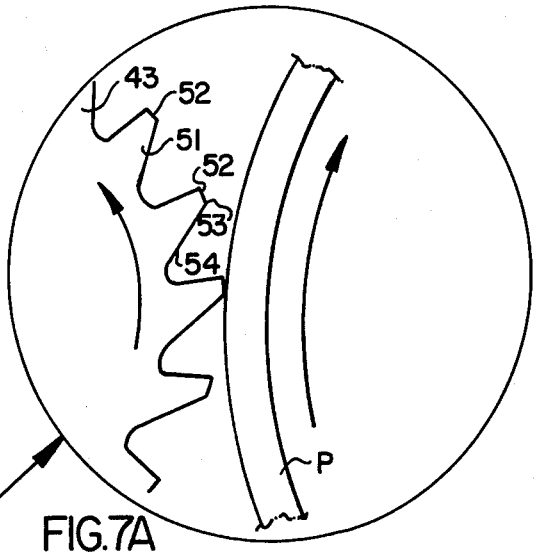
FIG. 7A
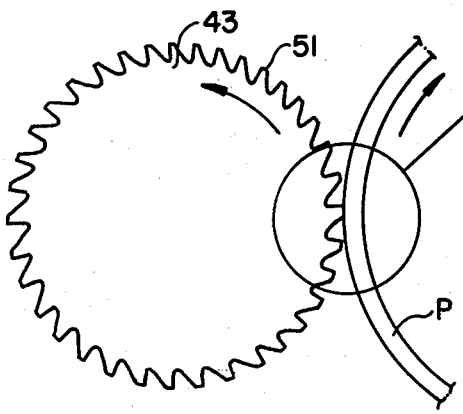
FIG. 7
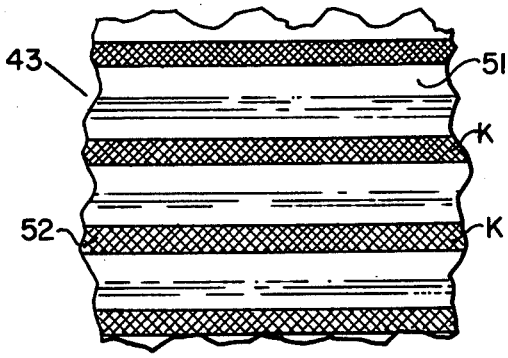
FIG. 8

POWERED PIPE WRENCH

RELATED APPLICATIONS

This is a continuation-in-part application of application Ser. No. 899,373, filed on or about Apr. 24, 1978 by John Gibson and entitled POWERED PIPE WRENCH, now abandoned.

BACKGROUND OF THE INVENTION

Power driven wrenches for assembling and disassembling lengths of threaded pipe have long been known. See, for example, U.S. Pat. No. 2,400,712 issued May 21, 1946 to Prather et al, U.S. Pat. No. 2,746,329 issued May 22, 1956 to W. W. Paget, U.S. Pat. No. 2,576,509 issued July 21, 1970 to Donald C. Duke et al, and U.S. Pat. No. 3,774,481 issued Nov. 27, 1973 to Earl H. Goodman. The tightening and loosening of the threaded connections of pipe lengths often requires the application of considerable torque to the pipe. For this reason the use of a powered wrench greatly facilitates the assembling and disassembling of lengths of pipe.

The requirement for the application of a considerable amount of torque presents a problem in gripping the pipe to be turned tightly enough to prevent relative movement between the pipe and the wrench. The prior art accomplishes this by the use of a hydraulic motor, mechanical linkage, and by a chain wrapped in serpentine fashion about the pipe and the driving means. While some of the prior art devices for rotating a pipe while preventing relative movement between the pipe and the wrench effectively accomplish their intended purpose, many of them result in cumbersome pieces of apparatus which require considerable labor and time to assemble about the pipe. Other prior art provides means to quickly position a pipe against driven rollers of a wrench but is not reliably effective to prevent relative movement between the pipe and the wrench.

Many of the prior art wrenches that effectively grip the pipe to prevent relative movement between the pipe and the wrench undesirably scar the surface of the pipe during its rotation because of the force with which the driven wheels engage and bite into the pipe to perform the desired function of rotating the pipe.

SUMMARY OF THE INVENTION

According to the present invention, the wrench may be quickly connected with a pipe by a strap fixed at one end to the housing of the wrench and adjustably connected at its other end to a threaded coupling on the opposite side of the housing. Manipulation of the threaded coupling enables infinitesimal adjustment to make the connection as tight as desired.

The instant pipe wrench relies on a single driven toothed roller to impart rotation to the pipe and three smooth surfaced idler rolls to support the pipe in operative relation with the driven roller. The teeth of the driven roller are preferably shaped to present a flat knurled surface to the pipe to provide a good grip and minimize scarring of the pipe. The idler rolls function to smooth the surface indentations made in the pipe by the tooth driven roll while imparting rotation to the pipe.

It is an object of this invention to provide a powered pipe wrench which may be quickly attached in operative relation to a pipe to be turned and which will reliably rotate the pipe and simultaneously smooth the surface of the pipe that has been engaged by the driven toothed roll.

BRIEF DESCRIPTION OF THE DRAWINGS

FIG. 5 is a perspective view of a length of pipe removed from a prior art powered pipe wrench after the pipe has been rotated by the prior art pipe wrench;

FIG. 5A is a perspective view of a length of pipe removed from the pipe wrench of the present invention and illustrating the relatively smooth surface of that portion of the pipe engaged by the toothed roller;

FIG. 6 is a view of the idler roll in front of the power driven roll and illustrating the relative dimensions of the idler roll and the power driven roll;

FIG. 7 is a fragmentary side view, with parts broken away, of the power driven roll in contact with a pipe;

FIG. 7A is an enlarged view of the circled portion of FIG. 7; and

FIG. 8 is an enlarged front view of the power driven roll.

DETAILED DESCRIPTION OF THE INVENTION

Figure 1:
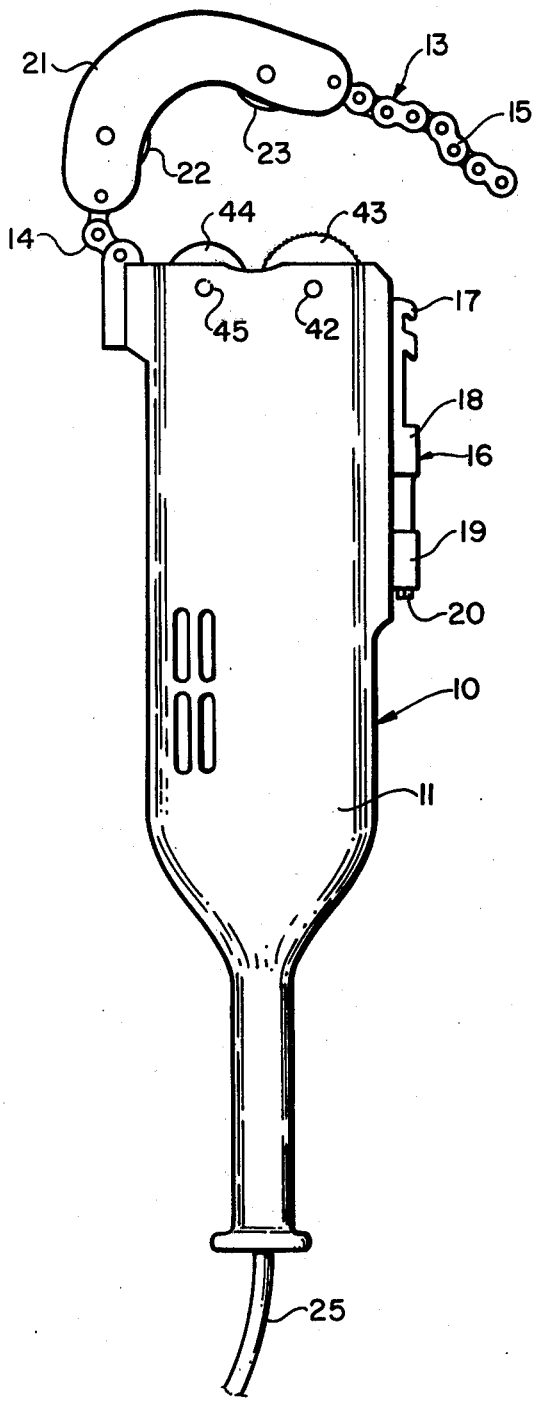
FIG. 1 is a side elevation of the powered wrench shown in open position.

Referring more specifically to the drawings, the numeral 10 broadly designates a powered pipe wrench including housing sections 11 and 12 suitably bolted together to provide a hollow housing. The wrench 10 includes a pipe retainer broadly indicated at 13 and including a first length of chain 14 and a second relatively longer length of chain 15. The relatively short length of chain 14 is fixed to the operating end of housing section 12 and the relatively longer length of chain 15 is adjustably connected to a threaded coupling 16 on the opposite side of housing section 12 from the point of attachment of chain 14 to the housing.

Figure 2:
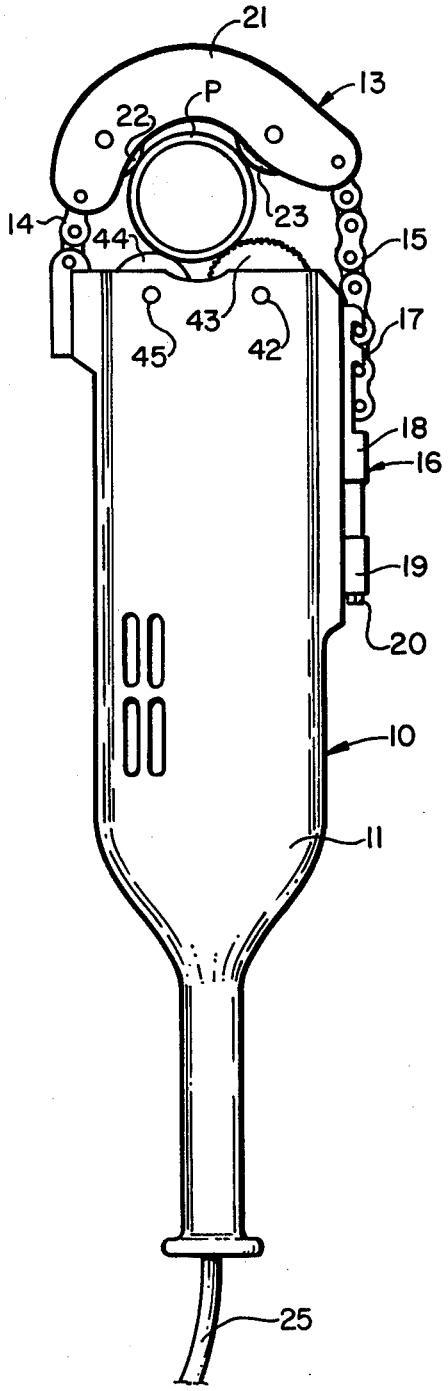
FIg. 2 is a view similar to FIG. 1 but showing the wrench closed in operative position about a pipe.
Figure 3:
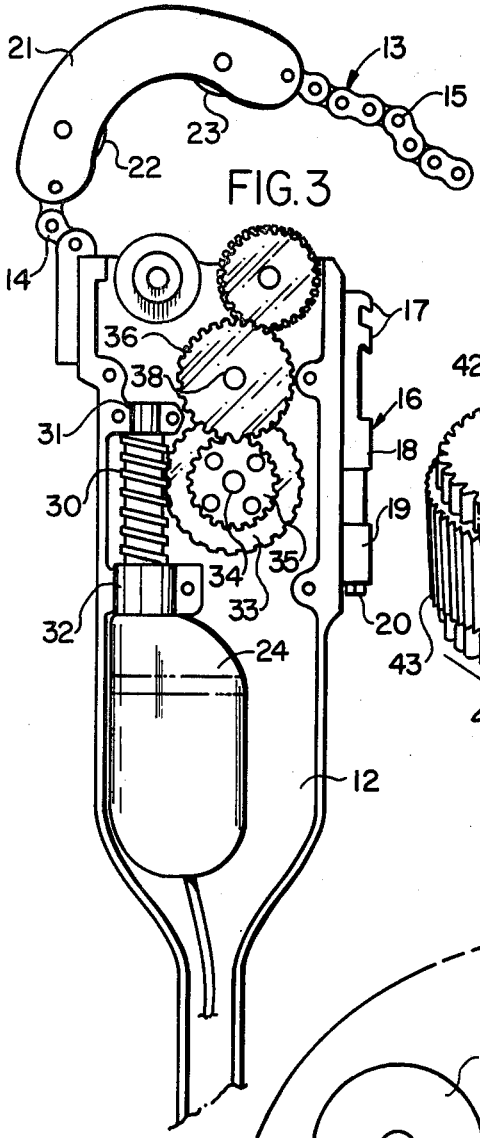
FIG. 3 is a sectional view taken in the same plane as FIGS. 1 and 2.
Figure 3A:
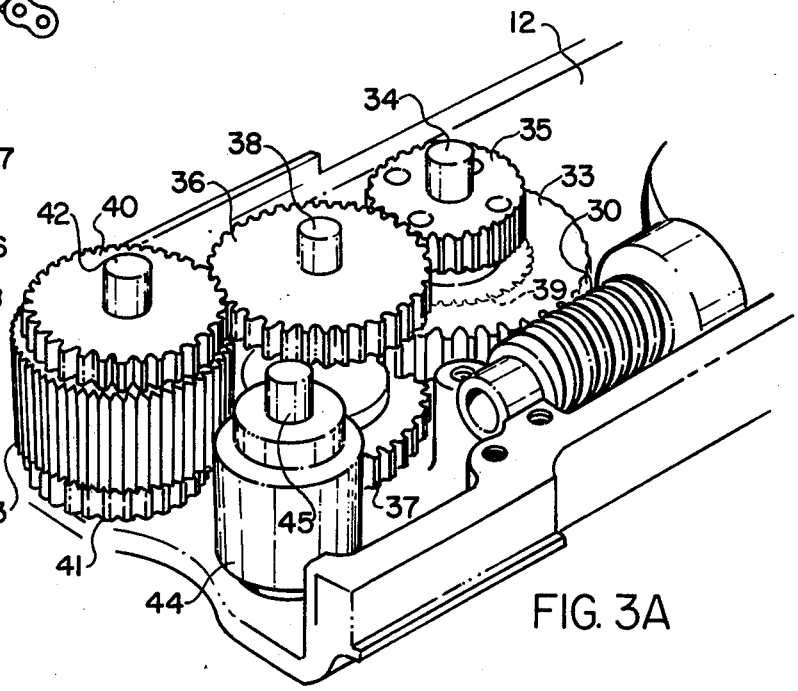
FIG. 3A is a fragmentary, perspective view of the gear train.
Figure 4:
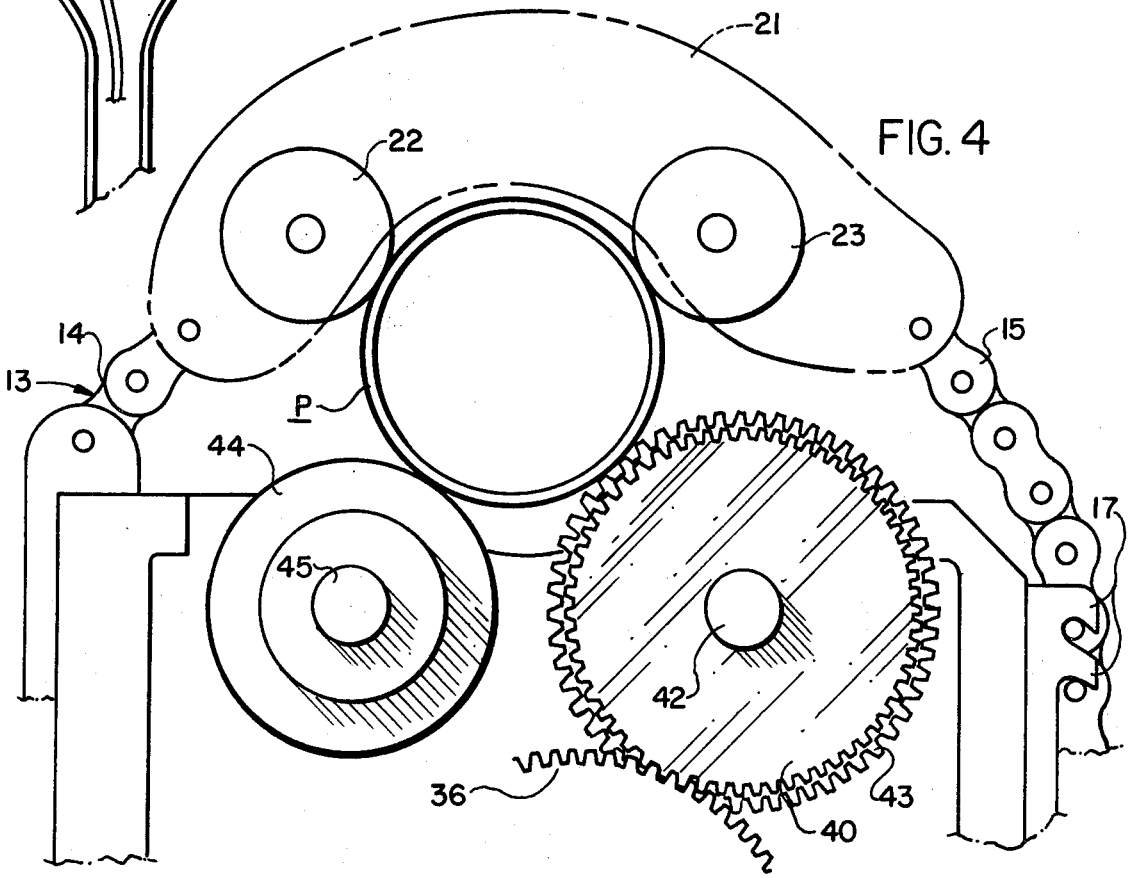
FIG. 4 is an enlarged view of the upper portion of FIG. 2, omitting part of the housing and showing the rigid saddle in phantom lines for purposes of illustration.

The threaded coupling 16 includes a plurality of hooks 17 selectively engagable with one or more lengths in the chain 15 of pipe retainer 13, depending upon the size of pipe to be retained in the wrench. The hooks 17 are formed integral with a movable slide 18 extending in threaded relation through a retaining block 19 fixed to housing section 12. The threaded portion of the slide 18 extends outwardly beyond the block 19 in a slotted or hexagonally shaped head 20 which may be manipulated to move the slide 18 longitudinally of the housing and its attached block 19 to tighten or loosen the grip on a pipe P held by the wrench 10 (FIGS. 2 and 4).

The pipe retainer 13 includes a rigid saddle 21 extending between the chain lengths 14 and 15 and adapted to overlie a pipe P in operative association with the wrench 10. The saddle 21 includes a pair of idler rolls 22 and 23 journaled between opposed side portions of the saddle 21 and adapted to engage pipe P operatively associated with wrench 10.

Suitably mounted within the housing of powered wrench 10 is a drive motor 24 suitably connected to an external source of power such as air, hydraulics, or electricity by a conduit 25 (FIG. 1). The motor 24 imparts rotation to a worm 30, the outer end of which is supported in a bearing 31 and the inner end of which may be supported in a bearing 32 adjacent the shaft of the motor 24. Worm 30 imparts rotation to a worm gear 33 journaled on a shaft 34. Also journaled on shaft 34 is a first spur gear 35 and a second spur gear 39 on the opposite side of worm gear 33 from spur gear 35. Additional spur gears 36 and 37 are journaled on shaft 38 which extends between housing sections 11 and 12. Rotation of worm gear 33 by worm 30 causes rotation of shaft 34 and of the spur gears 35 and 39 on the opposite sides of worm gear 33. The spur gears on shaft 34 mesh with the spur gears 36 and 37 on shaft 38 so that rotation of worm 30 by motor 24 imparts rotation to spur gears 36 and 37.

Additional spur gears 40 and 41 are mounted on shaft 42 which extends between the housing sections 11 and 12. A toothed driving roll 43 is mounted on shaft 42 between spur gears 40 and 41. Rotation of the spur gears 36 and 37 on shaft 38 imparts rotation to spur gears 40 and 41 on shaft 42 and consequently to driving roll 43 mounted between spur gears 40 and 41 on shaft 42.

An idler roll 44 is mounted on a shaft 45 extending between housing sections 11 and 12. The idler roll 44 is of lesser diameter than the driving roll 43 to lower the pipe P relative to the wrench 10 and more effectively seat the pipe P against the driving roll 43. Of course, the peripheries of driving roll 43 and idler roll 44 project beyond the operative end of the housing and beneath the saddle 21.

As most clearly seen in FIG. 4, pipe P is firmly gripped between the driving roll 43 and the three idler rolls 22, 23 and 44 when the wrench 10 is positioned about a pipe P and the chain 15 is connected to a hook 17 and securely tightened by manipulation of the head 30 on threaded coupling 16 to bring the idler rolls 22 and 23 in saddle 21 into engagement with pipe P. Rotation of the driving roll in the manner described will impart corresponding rotation to pipe P and as the torque increases the teeth on the driving roll will dig into the surface of the pipe P and scar it. FIG. 5 illustrates at 50 the scarred condition on the surface of a pipe which has been rotated with a power wrench of the prior art. The scarred area presents a hazard to those handling the pipe because of the slivers and sharp edges which are left in the area of the pipe indicated at 50 after having been rotated by a prior art wrench.

The teeth 51 in the driving roll 43 of the present invention have been designed and shaped to facilitate engagement of the pipe P as the torque increases and to minimize scarring of the pipe. As most clearly seen in FIGS. 7 and 7A no more than a coupled of teeth on driving wheel 43 engage the pipe P at any one time. The teeth 51 on driving wheel 43 are inclined at a negative angle relative to the direction of rotation and the tops of the teeth 51 are squared or flattened as at 52 to present a flat surface during the application of the highest torque to the pipe P. The flattened surfaces 52 are preferably roughened or knurled as at K (FIG. 8) to provide a good gripping and limit relative movement between the teeth 51 and pipe P. The juncture 53 of the flat outer surface of teeth 51 with the negatively inclined surface 54 of those teeth defines a sharp angle which facilitates initial engagement of pipe P by teeth 51. Then, as the torque increases the flat but knurled surfaces 52 engage the pipe P to minimize scarring of the pipe.

The idler roll 44 bears against pipe P under such pressure as to smooth any scarring of the pipe by the teeth 51 on the driving roll 43. As most clearly seen in FIG. 6 the idler roll 44 extends slightly beyond the edges of the driving roll 43 for the purpose of seating the idler roll against unscarred surfaces, indicated at 55 between the rows of dotted lines in FIG. 5A, to prevent the idler roll 44 from depressing the scarred area below the normal diameter of the pipe. The areas that have been scarred by the teeth 51 and smoothed by the idler roll 44 are indicated at 56 in FIG. 5A. Reference numeral 57 in FIG. 5A indicates a small scarred area which will inevitably be unsmoothed because of the distance between driving roll 43 and idler roll 44.

There is thus provided a power pipe wrench which may be quickly positioned about a pipe and readily tightened to firmly grip the pipe and hold it against relative movement during the application of high torque to the pipe. There is also provided a novel tooth arrangement which enables the surface area of the pipe engaged by the driving wheel to be relatively smooth and unscarred.

In the drawings and specification there has been set forth a preferred embodiment of the invention and although specific terms are employed they are used in a generic and descriptive sense only and not for purposes of limitation, the scope of the invention being defined in the following claims.

I claim:

1. A power pipe wrench comprising a housing, a drive motor mounted in said housing, only one driving roller rotatably mounted in said housing and protruding peripherally beyond one end of the housing, said driving roller having a toothed surface configuration, means driven by said motor for rotating said driving roller, a smooth surfaced idler roller rotatably mounted in said housing and extending peripherally beyond said one end of the housing, pipe retaining means carried by the housing, and means for positioning the said pipe retaining means about a pipe and attaching the pipe retaining means to opposite sides of the housing in operative relation to the driving roller and the idler roller, whereby said pipe is rotated from the toothed driving roller to the smooth surfaced idler roller and pressed against the smooth surfaced idler roller to smooth the surface of the pipe following its engagement by the driving roller.

2. A power pipe wrench according to claim 1 wherein the teeth of the driving roller have flattened outer surfaces and are inclined at a negative angle relative to the direction of rotation of the driving roller.

3. A power pipe wrench according to claim 2 wherein the flattened outer surfaces are knurled.

4. A power pipe wrench according to claim 1 wherein said pipe retaining means includes a rigid saddle extending across said one end of the wrench, a chain at each end of the rigid saddle, the chain at one end being fixed to one side of the housing, and means for releasably attaching the other chain to the other side of the housing.

5. A power pipe wrench according to claim 4 wherein the means for releasably attaching the other chain to the other side of the housing comprises a threaded coupling, and means for releasably attaching the chain to the threaded coupling.

6. A power pipe wrench according to claim 4 wherein said rigid saddle includes a pair of smooth surfaced idler rollers journaled therein and engageable in operative relation with a pipe about which the wrench is positioned.

7. A power pipe wrench according to claim 1 wherein the idler roller projects beyond said one end of the housing a lesser distance than the driving roller.

* * * * *